US010436417B2

(12) United States Patent
Freyermuth et al.

(10) Patent No.: US 10,436,417 B2
(45) Date of Patent: Oct. 8, 2019

(54) SIGNALLING APPARATUS FOR COMMAND AND/OR REPORTING DEVICES

(71) Applicant: EATON ELECTRICAL IP GMBH & CO. KG, Schoenefeld (DE)

(72) Inventors: Thomas Freyermuth, Kalenborn (DE); Stefan Boddenberg, Leichlingen (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/560,486

(22) PCT Filed: Mar. 17, 2016

(86) PCT No.: PCT/EP2016/055764
§ 371 (c)(1),
(2) Date: Jan. 17, 2018

(87) PCT Pub. No.: WO2016/150803
PCT Pub. Date: Sep. 29, 2016

(65) Prior Publication Data

US 2018/0142864 A1 May 24, 2018

(30) Foreign Application Priority Data

Mar. 23, 2015 (DE) ..... 10 2015 104 273

(51) Int. Cl.
*F21V 7/00* (2006.01)
*F21S 8/00* (2006.01)
(Continued)

(52) U.S. Cl.
CPC ..... *F21V 7/0066* (2013.01); *F21S 8/00* (2013.01); *G08B 5/36* (2013.01); *F21W 2111/00* (2013.01);
(Continued)

(58) Field of Classification Search
CPC . F21V 7/0066; F21S 8/00; G08B 5/36; F21Y 2113/10; F21Y 2115/10; F21W 2111/00
(Continued)

(56) References Cited

U.S. PATENT DOCUMENTS

2006/0147151 A1 7/2006 Wanninger et al.
2007/0002572 A1* 1/2007 Ewig ..... B64D 47/06 362/470
2015/0323142 A1* 11/2015 Shigematsu ..... F21K 9/61 362/235

FOREIGN PATENT DOCUMENTS

DE 102004063574 A1 7/2006
EP 1677045 A2 7/2006
(Continued)

*Primary Examiner* — Anh T Mai
*Assistant Examiner* — Jessica M Apenteng
(74) *Attorney, Agent, or Firm* — Leydig, Voit & Mayer, Ltd.

(57) ABSTRACT

A signaling apparatus for command and/or indicating devices includes a base unit having at least two light sources which each generate light and are arranged on the base unit at a spacing from one another, and at least two light modules which are stacked along a main axis of the signaling apparatus and are operatively connected to the light sources such that light generated by the light sources is coupled into the light modules in a beam direction parallel to the main axis, the light modules each having a reflection region for reflecting at least in part the light coupled into the light modules in a signaling direction. A particular reflection region occupies only a portion of the light module in a peripheral direction of the corresponding light module perpendicular to the main axis of the signaling apparatus, which portion is smaller than a total periphery of the light module.

10 Claims, 2 Drawing Sheets

(51) Int. Cl.

| | |
|---|---|
| ***G08B 5/36*** | (2006.01) |
| *F21W 111/00* | (2006.01) |
| *F21Y 115/10* | (2016.01) |
| *F21Y 113/10* | (2016.01) |

(52) U.S. Cl.
CPC ..... *F21Y 2113/10* (2016.08); *F21Y 2115/10* (2016.08)

(58) Field of Classification Search
USPC ..... 362/241
See application file for complete search history.

(56) References Cited

FOREIGN PATENT DOCUMENTS

| | | | |
|---|---|---|---|
| EP | 2713100 | A1 | 4/2014 |
| WO | WO 2012132882 | A1 | 10/2012 |

* cited by examiner

SIGNALLING APPARATUS FOR COMMAND AND/OR REPORTING DEVICES

CROSS-REFERENCE TO PRIOR APPLICATIONS

This application is a U.S. National Phase application under 35 U.S.C. § 371 of International Application No. PCT/EP2016/055764, filed on Mar. 17, 2016, and claims benefit to German Patent Application No. DE 10 2015 104 273.8, filed on Mar. 23, 2015. The International Application was published in German on Sep. 29, 2016 as WO 2016/150803 under PCT Article 21(2).

FIELD

The invention relates to a signaling apparatus for command and/or indicating devices.

BACKGROUND

Signaling apparatuses according to the prior art comprise in particular a plurality of light modules which are stacked along a main axis of the signaling apparatus. In this case, a light source is arranged in each light module in order to generate light which can be emitted outwardly from the light module in a signaling direction in order to allow signals to be displayed accordingly. A signaling apparatus of this type according to the prior art is shown by way of example in FIG. 1. In most cases, corresponding signaling apparatuses are used in industry as signaling equipment in the form of traffic lights and intended for machines.

Signaling apparatuses of this kind are disadvantageous in that they are relatively complex to produce because a light source having a corresponding electric or electronic system and electrical supply lines has to be provided in each of the light modules.

In particular, in the case of "multicolor apparatuses", in which a plurality of light colors are displayed, there are therefore a wide range of combinations of light modules which are to be produced in different ways and which comprise corresponding light sources. Furthermore, it is also complex and expensive to construct signaling apparatuses of this kind in view of the "standby light function" for cases where a light source fails.

In particular in the case of signal columns in which cables of above low voltages (5 V, 12 V), for example a mains voltage of 110 V or 230 V, are located, contact-proof insulation should be ensured when the electrical signals are transmitted from the base unit to the individual, stacked light modules. For example, when removing a module, live parts must not be allowed to make contact.

There are already other solutions provided by signaling apparatuses which avoid the aforementioned disadvantages to some extent.

A signaling apparatus according to a solution of this kind comprises a base unit having at least two light sources which are each intended for generating light and are arranged on the base unit at a spacing from one another. Furthermore, the signaling apparatus comprises at least two light modules which are stacked along a main axis of the signaling apparatus and are operatively connected to the light sources such that light generated by the light sources is coupled into the light modules in a beam direction parallel to the main axis. Moreover, the light modules each have a reflection region for reflecting at least in part the light coupled into the light modules in a signaling direction.

Signaling apparatuses of this kind are advantageous over other solutions from the prior art in that the light sources no longer have to be built into the respective light modules individually, since light sources are installed in a base unit together with the electric or electronic system thereof. By means of optical light guides, for example optical waveguides, the light is conducted to a corresponding emission position and outwardly emitted therefrom in a signaling direction by means of corresponding reflection regions.

However, these solutions are still disadvantageous in that the signaling apparatuses are relatively complex to construct with regard to the individual light modules, which generally comprise individual elements that are constructed so as to have different geometries in order to receive light information from different and/or locally distributed light sources along the signaling apparatus and to outwardly emit said light information to the intended emission position of the signaling apparatus. Even signaling apparatuses of the type mentioned last are thus still disadvantageous in that the construction thereof is complex.

SUMMARY

In an embodiment, the present invention provides a signaling apparatus for command and/or indicating devices, comprising: a base unit having at least two light sources which are each configured to generate light and are arranged on the base unit at a spacing from one another; and at least two light modules which are stacked along a main axis of the signaling apparatus and are operatively connected to the light sources such that light generated by the light sources is coupled into the light modules in a beam direction parallel to the main axis, the light modules each having a reflection region configured to reflect at least in part the light coupled into the light modules in a signaling direction, wherein a particular reflection region occupies only a portion of the light module in a peripheral direction of the corresponding light module perpendicular to the main axis of the signaling apparatus, which portion is smaller than a total periphery of the light module, and wherein the reflection region of a light module is arranged so as to be offset relative to the reflection region of another light module by a predetermined angle perpendicular to the main axis, the reflection regions being at a same radial distance from the main axis.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 2:
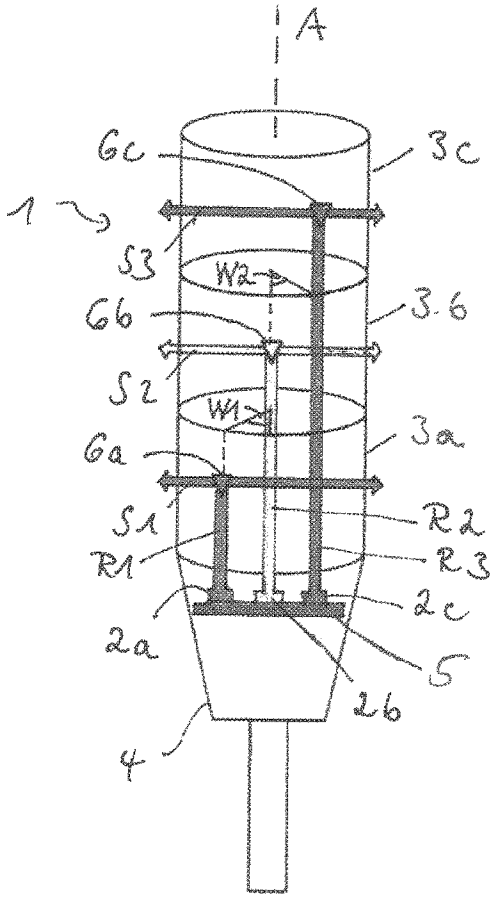
FIG. 2 shows an embodiment of a signaling apparatus according to the invention.

In an embodiment, the present invention provides a signaling apparatus of the aforementioned type by a particular reflection region of a light module only occupying a portion of the light module in the peripheral direction of the corresponding light module perpendicular to the main axis of the signaling apparatus, which portion is smaller than the total periphery of the light module, and by a reflection region of a light module being arranged so as to be offset relative to a reflection region of another light module by a predetermined angle perpendicular to the main axis, the reflection regions being at the same radial distance from the main axis.

Outside of the reflection region of the light module, light, which is incident on the light module in parallel with the main axis, is transmitted to another adjacent light module, for example, in the direction of the main axis. This can be provided in particular in regions that are arranged at the same radial distance and at a predetermined angle such that the light in the adjacent light module(s) strikes the reflection region located thereon.

The light in the light modules can be transmitted by holes parallel to the main axis, for example. In this case, the walls of the holes have reflective properties, such as can be produced for example by the surface of the material of the light modules being polished or by means of a reflective coating. For example, the holes may also contain light guides made of a light-guiding material, such as a transparent plastics material or glass, which has a refractive index that is different from that of the material of the light modules, such that this leads to reflection on the surface to the material of the light modules.

A signaling apparatus of this kind has various advantages over the solutions from the prior art. As already explained, one advantage is that the electric or electronic system for generating light is no longer required in the light modules themselves. Instead, light is generated by means of light sources in a base unit, such that light is generated at a central point and is conducted to a particular emission position in a light module by means of the light modules and reflection regions. This results in a simple design with regard to the light sources and the electrical connection thereof.

The saved space can be used to accommodate a large number of holes or light guides parallel to the main axis. While current signal columns usually contain up to 5 light modules, it is conceivable in this way for there to be a larger number, for example 8, 12 or even 24 modules.

Furthermore, the overall height can be reduced. Current light modules have a height of 60-70 mm. The overall height can be reduced by 20 mm, for example, since no electrical elements have to be integrated in the light module. The closer arrangement of the individual signaling regions produced in this manner makes it possible for more signaling means to be accommodated at a comparable overall height and thus also provides for new signaling means, such as a chaser light in the signaling region or within part of the signaling region.

Furthermore, these signaling apparatuses are advantageous in that light information from different, locally distributed light sources can be conducted to a corresponding emission position in a simple manner, both in different ways and separately from one another, purely owing to the geometric relationship to associated reflection regions of the light modules.

Owing to the stacked arrangement of the light modules, each of the reflection regions of the light modules is located in a separate plane perpendicular to the main axis. The light modules are coded by means of predetermined light sources merely by the reflection regions of the light modules being angularly offset by a predetermined angle perpendicular to the main axis of the signaling apparatus, the reflection regions having the same radial distance from the main axis. This significantly simplifies the construction of the individual light modules. In this context, the expression "by a predetermined angle perpendicular to the main axis" means that the reflection regions are offset by an angle in a rotational direction around the main axis, acting as the rotational axis. In an advantageous embodiment, the light modules are rotationally symmetrical. Alternatively, however, other forms and shapings are also conceivable.

In this way, the above-described signaling apparatus results in the light guides of the various light sources no longer being laborious to construct with regard to corresponding reflection regions at different positions of the signaling apparatus. Furthermore, in this way, the light guides can be prevented from impairing or interfering with one another. A corresponding signaling apparatus is in particular advantageous in "multicolor apparatuses" in which light sources and light information of different colors are used, for example in signal equipment of the aforementioned type that are in the form of traffic lights.

The construction of the above-described signaling apparatus is significantly simplified and the design thereof is simplified and more cost-effective by comparison with the solutions from the prior art.

The reflection regions of the corresponding light modules that are arranged so as to be offset by a predetermined angle perpendicular to the main axis are at the same radial distance from the main axis. In an alternative embodiment, in addition to the group of reflection regions explained above, it is conceivable for a further group of additional reflection regions to be provided such that at least two reflection regions are arranged in one light module. The respective radial distances of the first group of reflection regions and of the second group of reflection regions relative to the main axis may be the same, but may also be different. Within a group of reflection regions, the radial distance from the main axis is the same, however. Corresponding groups of reflection regions can, for example, be arranged such that they extend "annularly" from the main axis at different radial distances from the main axis.

Embodiments of this kind can be advantageous when the individual light sources are arranged on the base unit of the signaling apparatus, and allow for there to be a certain degree of flexibility in the design. Advantageously, in this way, a standby light functionality can also be provided in which the light is decoupled from a plurality of light regions (for example from two light regions) in a light module. In this way, when a light element fails, the light from at least one other light element in the light module is still decoupled, and therefore the signaling function is provided in this case too. This makes it possible for the failure safety of the signal column to be increased.

Alternatively, the use of a plurality of reflection regions in the module can make additional uses possible. For example, differently colored light can thus be coupled in by means of different reflection regions such that mixed colors are possible. By actuating the lamp in a temporally variable manner, the brightness or intensity of the individual light colors can be controlled and thus the mixed color can be modified. This makes it possible for additional light effects to also be produced, such as multicolored flashing.

In an advantageous embodiment, the reflection regions of the light modules are each arranged so as to be aligned with at least one of the light sources in a direction parallel to the main axis in order to reflect emitted light from the corresponding light source. This results in a simple assignment of a corresponding reflection region in a light module to one or more light sources, which are provided on the base unit so as to be locally remote from the relevant light module.

Advantageously, an arrangement of the light sources on the base unit thus corresponds to a rotationally offset arrangement of the reflection regions in the individual light modules. The light generated by a light source is transported by means of the individual light modules substantially along a direction parallel to the main axis of the apparatus as far as a corresponding reflection region. At a suitable location, the coupled-in light is then reflected and emitted outwardly in a signaling direction.

The light information from a first light source can thus be transported to a first reflection region of a first light module, for example in a beam direction parallel to the main axis, the light information from a second light source, which is arranged so as to be locally offset from the first light source, being transported to a second reflection region of a second light module in a beam direction parallel to the main axis. A construction of this type facilitates a simple design of a signaling apparatus and therefore provides for a desired functionality in which different pieces of light information are differentiated at different emission positions on the signaling apparatus.

In an advantageous embodiment, all of the reflection regions of the light modules are identical. This makes the light modules even simpler to construct. Light information from the different light sources is uniformly directed in the apparatus and reflected outwardly in a signaling direction. In this case, the reflection regions can be uniformly constructed for light sources that are nevertheless in different positions, these different positions being allowed for by the reflection regions of the different light modules being angularly offset from one another.

According to an advantageous embodiment, all of the light modules have the same design. This means that, in addition to the reflection regions of the light modules, the other components of the light modules also have the same design. This is the simplest construction of the signaling apparatus because, despite there being different light sources having optionally different light information, just one single component part of a light module has to be produced multiple times. The light modules are stacked one on top of the other along the main axis of the signaling apparatus and, as already explained, are arranged so as to be rotationally offset by a predetermined angle. In this case, the light modules may be colored differently or may contain differently colored color filters. This results in a uniform, cost-effective process for producing the light modules especially for multisource or multicolor apparatuses. Therefore, in an embodiment of this kind, not only is there no need for the electric or electronic system and/or electrical supply lines in the individual light modules for generating light, but the geometries of the light modules can also be standardized, a geometric relationship to the light sources being established purely by the reflection regions of the light modules being rotationally offset.

According to an advantageous embodiment, a focusing unit is provided on the signaling apparatus in order to focus and/or guide the light generated by the respective light sources such that a dome of light is formed for each light source, which dome is oriented substantially in a beam direction parallel to the main axis of the signaling apparatus. The aforementioned focusing unit can be for example apertures, grids, lenses, optical waveguides, etc. The focusing unit ensures that light beams are generated such that the amount of loss is as low as possible and ensure that said light beams are transmitted in order for the generated light to be coupled into the corresponding light modules. Furthermore, the scattered light generation is reduced or suppressed, as a result of which light can be emitted to the corresponding light modules via the reflection regions in as precise a manner as possible and such that there is as little interference as possible. This helps to give the signaling apparatus a good signaling property.

In an advantageous embodiment, the light modules of the signaling apparatus are each formed of a solid illuminant in which the reflection regions are incorporated.

The illuminant may be formed, for example cast, from a transparent composite material, for example. Under certain circumstances, the surfaces where an illuminant adjoins another illuminant might be worked, for example polished, in order to reduce reflection losses or scattering losses and to improve coupling properties of the light emitted from the light sources into the illuminants. In this way, despite a stacked arrangement of a plurality of light modules or illuminants, the signaling apparatus is designed to guide the light through the stacked illuminants towards a corresponding reflection region of a particular illuminant such that there is a low amount of loss.

According to an advantageous embodiment, an illuminant may have, along its periphery perpendicular to the main axis, a surface that is designed specifically for decoupling the light from the light modules in a desired manner. A surface of this kind can for example have diffuse reflection properties or a frosted or milk glass surface. This can ensure that light, which is reflected on the reflection regions of the light modules outwardly in the direction of a signaling direction, is conducted along the entire periphery of the illuminant and then emitted outwardly. As a result, a light module or illuminant can be lit up or illuminated in an even manner along the periphery, and this leads to an even appearance of a signaling means. Therefore, signaling by means of the signaling apparatus is independent of the angle and/or orientation at which the signaling apparatus is viewed. This appears to be favorable in particular in the industrial environment in which it is necessary or advantageous for corresponding signaling apparatuses to be viewed from 360°.

In an advantageous embodiment, the reflection regions in the light modules are formed by optical mirror elements. Alternatively, the reflection regions in the light modules could also be formed by optical irregularities which lead to an incident light beam being refracted or reflected. Optionally, junctions having different refractive indices can also be used in the light modules, optionally in combination with the aforementioned features, in order to deflect an incident light beam in a signaling direction.

Here, various implementations are conceivable within the scope of the activities of a person skilled in the art.

Additional advantageous embodiments are disclosed in the following description of the figures and in the dependent claims.

Figure 1:
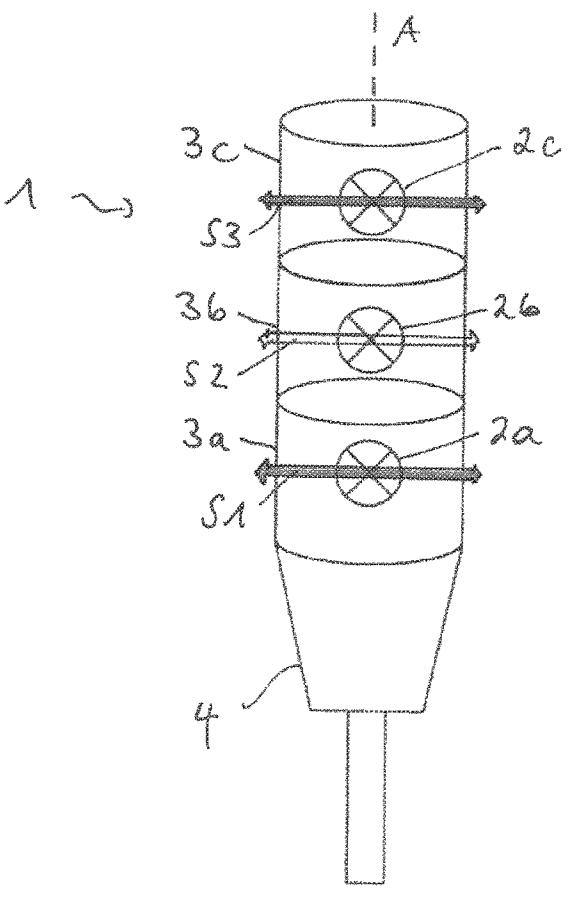
FIG. 1 shows a signaling apparatus according to the prior art.

The invention is explained in more detail in the following with reference to several drawings, in which:

FIG. 1 is a perspective schematic view of a signaling apparatus 1 according to the prior art. The signaling apparatus 1 substantially comprises a bottom region 4, which is used as the base for the signaling apparatus 1 for mounting and electrically connecting said apparatus to a power supply. Starting from the bottom region 4, three light modules 3*a*, 3*b* and 3*c* are stacked one on top of the other along a main axis A, which extends perpendicularly in FIG. 1. A light source 2*a*, 2*b* and 2*c* is provided in each of the light modules 3*a*, 3*b* and 3*c*, respectively, which light sources are designed to generate and emit light in a signaling direction S1, S2 and S3, respectively, which, by way of example, is a horizontal emission direction in FIG. 1. The light sources 2*a*, 2*b* and 2*c* can, for example, generate light of different colors, e.g. red, yellow and blue or red, yellow and green, etc.

A solution of this kind is disadvantageous in that a light source 2*a*, 2*b* and 2*c* having a corresponding electric or electronic system and corresponding supply lines, from the bottom region 4 towards the corresponding light module 3*a*, 3*b* and 3*c*, has to be provided in each light module 3*a*, 3*b* and 3*c*. In particular in multicolor apparatuses, in which the light modules 3*a*, 3*b*, 3*c* represent different tones of color, constructing the apparatuses in this manner is complex because the light modules 3*a*, 3*b* and 3*c* have to be produced in different ways. For example, for each light source a separate electric or electronic system has to be provided, it also being possible for the light sources to be different from one another. Additional functions, such as color changes, standby light functions for cases where a light source fails, etc., can also only be produced in this case with a significant degree of constructional complexity. Generally, one or more different light modules have to be produced for different pieces of color information of a corresponding signaling apparatus. This results not least in a significant outlay for producing a corresponding signaling apparatus 1. Actuating the corresponding light modules 3*a*, 3*b* and 3*c* is also complex in corresponding signaling apparatuses 1 because corresponding supply lines to each light module 3*a*, 3*b* and 3*c* are provided.

FIG. 2 is a perspective schematic view of a signaling apparatus 1 according to the invention. In this signaling apparatus 1, a base unit 5 is provided in the bottom region 4, on which base unit a plurality of light sources 2*a*, 2*b* and 2*c* are provided. The base unit 5 comprises for example a printed circuit board on which the light sources 2*a*, 2*b* and 2*c* are provided in the form of light-emitting diodes. The light sources 2*a*, 2*b* and 2*c* can be designed such that they generate different color information and/or light of different brightness levels. It is however also conceivable for the light sources 2*a*, 2*b* and 2*c* to be identical.

Like the signaling apparatus 1 according to FIG. 1, the signaling apparatus 1 also comprises a plurality of light modules 3*a*, 3*b* and 3*c* which are stacked along the perpendicular main axis A.

Unlike in the embodiment according to FIG. 1, the individual light modules 3*a*, 3*b* and 3*c* do not have any integrated light sources, however. Instead, reflection regions 6*a*, 6*b* and 6*c* are provided in the corresponding light modules 3*a*, 3*b* and 3*c*. The reflection regions 6*a*, 6*b* and 6*c* can be in the form of optical mirror elements, for example.

Safety is increased on account of there being no live component parts or lines.

The individual light modules 3*a*, 3*b* and 3*c* have substantially the same design. This means that the individual light modules 3*a*, 3*b* and 3*c* can be produced according to a uniform production method. Therefore, the light modules 3*a*, 3*b* and 3*c* do not have to produced in different ways. The light modules 3*a*, 3*b* and 3*c* are rotationally symmetrical. Alternatively, however, other shapings may also be used.

The light modules 3*a*, 3*b* and 3*c* are, as shown in FIG. 2, arranged relative to one another such that they are arranged so as to be offset from one another by a predetermined angle perpendicular to the main axis A. This means that the reflection regions 6*a*, 6*b* and 6*c* are each arranged so as to be offset from one another by a predetermined angle around the main axis A, acting as the rotational axis. The reflection region 6*b* is offset relative to the reflection region 6*a* by an angle W1 perpendicular to the main axis A, whereas the reflection region 6*c* is offset further relative to the reflection region 6*b* by an angle W2 perpendicular to the main axis A. Relative to the reflection region 6*a*, the reflection region 6*c* is thus arranged so as to be offset by an angle W1+W2 perpendicular to the main axis A.

The individual reflection regions 6*a*, 6*b* and 6*c* of the light modules 3*a*, 3*b* and 3*c* are each arranged so as to be aligned with one of the light sources 2*a*, 2*b* and 2*c* in a direction parallel to the main axis A. In particular, according to FIG. 2, the reflection region 6*a* is arranged so as to be aligned with the light source 2*a*, the reflection region 6*b* is arranged so as to be aligned with the light source 2*b*, and the reflection region 6*c* is arranged so as to be aligned with the light source 2*c*. In this way, a relationship is established between the individual light modules 3*a*, 3*b* and 3*c* and the corresponding light sources 2*a*, 2*b* and 2*c* such that light from the light source 2*a* can be deflected towards the outside of the signaling apparatus 1 in a signaling direction S1 by means of the reflection region 6*a*, whereas light from the light source 2*b* can be deflected towards the outside of the signaling apparatus 1 in a signaling direction S2 by means of the reflection region 6*b*, and light from the light source 2*c* can be deflected towards the outside of the signaling apparatus in a signaling direction S3 by means of the reflection region 6*c*. In FIG. 2, the signaling directions S1, S2 and S3 are shown to be horizontal.

Therefore, when lit up, the light module 3*a* radiates light information emitted by the light source 2*a*, in particular color information, whereas the light module 3*b* radiates light information or color information from the light source 2*b*, and the light module 3*c* radiates light information or color information from the light source 2*c*. In particular in multicolor apparatuses in which the light sources 2*a*, 2*b*, and 2*c* represent different color information, these three different colors can thus be accordingly reproduced by the three light modules 3*a*, 3*b* and 3*c*.

Advantageously, the signaling apparatus 1 according to FIG. 2 comprises a focusing unit for focusing and/or guiding the light generated by the respective light sources 2*a*, 2*b* and 2*c* such that a dome of light is formed for each light source 2*a*, 2*b* and 2*c*, which dome is oriented substantially in the beam direction R1, R2 and R3, respectively, parallel to the main axis A of the signaling apparatus 1.

Focusing means of this kind may be for example apertures, grids, lenses, optical waveguides or a combination of elements of this kind. This ensures that light beams are generated such that the amount of loss is as low as possible and ensures that said light beams are transmitted by the individual light modules 3*a*, 3*b* and 3*c* towards the corresponding reflection regions 6*a*, 6*b* and 6*c*.

In the individual light modules 3*a*, 3*b* and 3*c*, the light can be transmitted by holes, for example. In this case, the walls of the holes have reflective properties, such as can be produced for example by the surface of the material of the light modules being polished or by means of a reflective coating. For example, the holes may also contain a light-guiding material, such as a transparent plastics material or glass, which has a refractive index that is different from that of the material of the light modules, such that this leads to reflection on the surface to the material of the light modules.

According to the signaling apparatus 1 from FIG. 2, this means that light from the light sources 2*a*, 2*b* and 2*c* can be emitted in a very cost-effective manner purely by the geometric relationship, in particular by the light modules 3*a*, 3*b* and 3*c* being rotationally offset from one another. In this case, all of the light modules 3*a*, 3*b* and 3*c* can be produced in a uniform production method, there being no need to design the light modules 3*a*, 3*b* and 3*c* such that their construction is different depending on the orientation and alignment towards the light sources 2*a*, 2*b* and 2*c*.

In the simplest case, the light modules 3*a*, 3*b* and 3*c* each comprise an illuminant having reflection regions 6*a*, 6*b* and 6*c* incorporated therein. There is no need to provide an electric or electronic system, let alone individual light sources, directly in the light modules 3*a*, 3*b* and 3*c*. This makes it easier and less expensive to produce a signaling apparatus 1.

Depending on the desired configuration of a signaling apparatus 1, only a predetermined number n of light modules have to be stacked one on top of the other and rotationally offset by a predetermined angle such that each light module is operatively connected to one light source, and the generated light can be reflected and outwardly emitted by means of the corresponding reflection region in the light module.

It is also conceivable for reflection regions of the light modules to be designed such that they reflect light from a plurality of light sources. Here, it would also be conceivable for mixed colors from the individual light sources to be generated and outwardly emitted at the corresponding light modules of the signaling apparatus 1. A standby light function can also be produced in this way.

Figure 3B:
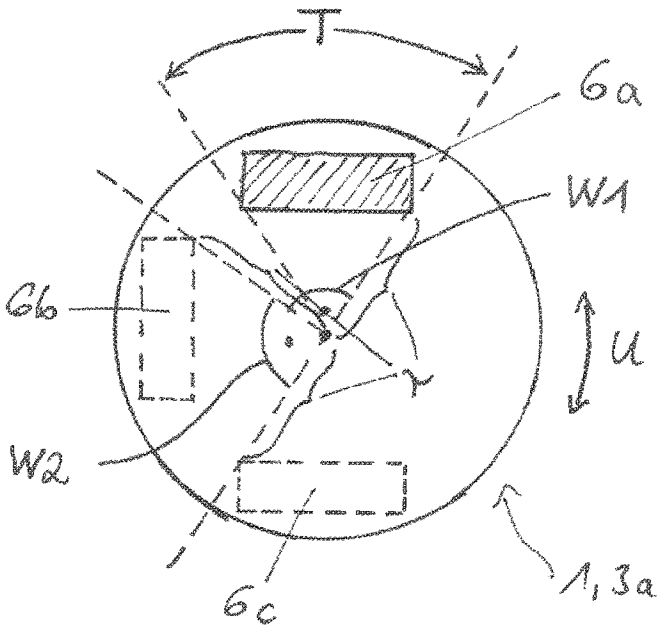
FIG. 3B is a schematic plan view of another embodiment of a signaling apparatus according to the invention.
Figure 3A:
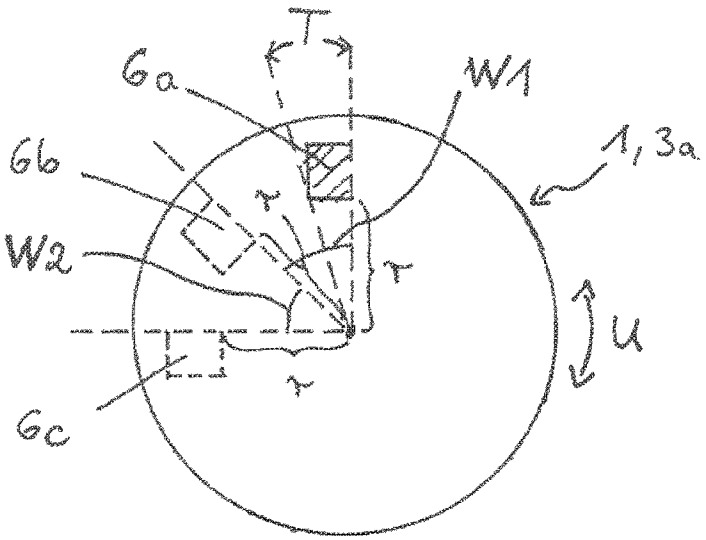
FIG. 3A is a schematic plan view of an embodiment of a signaling apparatus according to the invention.

FIG. 3A is a schematic plan view from above of a signaling apparatus 1, as shown in FIG. 2 for example, the main axis A (cf. for example FIG. 2) leading out of the plane of the drawing. FIG. 3A shows a schematic arrangement of individual reflection regions 6*a*, 6*b* and 6*c* relative to one another. FIG. 3A shows by way of example a section through the light module 3*a* from FIG. 2 at the level of the reflection region 6*a*, the position of the reflection region 6*a* relative to the two other reflection regions 6*b* and 6*c* being shown schematically.

The reflection regions 6*a*, 6*b* and 6*c* are designed such that they each only occupy a portion T of the light module, in this case 3*a*, in the peripheral direction U perpendicular to the main axis A which leads out of the plane of the drawing, which portion is smaller than the total periphery of the light module 3*a*. In this way, the reflection regions 6*a*, 6*b* and 6*c* are separate regions which are arranged separately at a predetermined location in a light module or relative to the entire signaling apparatus 1. As already explained in connection with FIG. 2, the reflection regions 6*a*, 6*b* and 6*c* are arranged along the main axis A so as to be aligned with a light source 2*a*, 2*b* and 2*c*, respectively.

FIG. 3A shows the angular offset between the reflection regions 6*a*, 6*b* and 6*c*. In particular, the reflection region 6*b* is arranged so as to be offset or rotated relative to the reflection region 6*a* by an angle W1 perpendicular to the main axis A acting as the rotational axis. The reflection region 6*c* is in turn arranged so as to be offset or rotated relative to the reflection region 6*b* by an angle W2 perpendicular to the main axis A, acting as the rotational axis. The two angles W1 and W2 may be the same, but also different, depending on the configuration of the signaling apparatus 1. The radial distance r between the reflection regions 6*a*, 6*b* and 6*c* and the central main axis A is the same in each case.

This establishes a geometric relationship to the corresponding light sources 2*a*, 2*b* and 2*c* merely by the light modules 3*a*, 3*b* and 3*c* together with their respective reflection regions 6*a*, 6*b* and 6*c* (cf. FIG. 2) being rotationally offset.

FIG. 3B is a schematic plan view of a signaling apparatus 1 according to another embodiment, a section through the light module 3*a* at the level of the reflection region 6*a* being shown, as in FIG. 3A. What was explained in relation to FIG. 3A substantially also applies similarly in connection with FIG. 3B.

Only the shaping of the respective reflection regions 6*a*, 6*b* and 6*c* is different, which reflection regions are shown to be wider in FIG. 3B than in the embodiment according to FIG. 3A, such that the portion T assumed by a reflection region in the peripheral direction U as a proportion of the total periphery is larger than that in the embodiment according to FIG. 3A. A corresponding angular offset between the reflection regions 6*a* and 6*b* and 6*b* and 6*c* by an angle W1 and an angle W2, respectively, is also greater in FIG. 3B than in the embodiment according to FIG. 3A. In the embodiment according to FIG. 3B, the angles W1 and W2 are each perpendicular angles with a value of 90°.

In embodiments that are not shown, a signaling apparatus 1 of the explained type can also comprise light sources that are arranged on a base unit such that they are not aligned with corresponding reflection regions 6*a*, 6*b* and 6*c* of light modules 3*a*, 3*b* and 3*c*. In this case, it is conceivable for light emitted by light sources to be guided by means of corresponding optical waveguides towards the light modules 3*a*, 3*b* and 3*c* such that the light is coupled into the light modules 3*a*, 3*b* and 3*c* in a beam direction R1, R2 and R3, respectively, parallel to the main axis A (cf. FIG. 2).

Furthermore, by means of the shown embodiments, it is also conceivable for a plurality of light modules comprising corresponding reflection regions to be arranged such that they are in a geometric relationship with corresponding light sources, it being possible to freely select the geometric design, arrangement and geometric angular offset of the reflection regions of the individual light modules relative to one another according to requirements within the scope of the knowledge of a person skilled in the art, without having to deviate from the core concepts of the invention presented here.

Furthermore, it is conceivable for electrical cables, for example bus lines, to be located in the light modules, which lines are, however, not required in the individual light modules in order to generate light or emit light, as already explained. Rather, cables of this kind can be used for additional electrical tasks of a signaling apparatus 1 of the explained type.

Advantageously, signaling apparatuses 1 of the explained type are signal columns, inter alia, for command and/or indicating devices of any type, for example.

The embodiments shown are selected only by way of example.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 signaling apparatus
2*a*, 2*b*, 2*c* light sources
3*a*, 3*b*, 3*c* light modules
4 bottom region
5 base unit
6*a*, 6*b*, 6*c* reflection region
A main axis
R1, R2, R3 beam directions
S1, S2, S3 signaling directions
T portion on the periphery
U peripheral direction
W1, W2 angular offset
r radial distance from main axis

The invention claimed is:

1. A signaling apparatus for at least one of a command device or an indicating device, the signaling apparatus having a main axis extending along a longitudinal length of the signaling apparatus, the signaling apparatus comprising:

a base unit having at least two light sources which are each configured to generate light and are arranged on the base unit at a spacing from one another; and at least two light modules which are stacked along the main axis of the signaling apparatus and are operatively connected to the light sources such that light generated by the light sources is coupled into the light modules in a beam direction parallel to the main axis, the light modules each having a reflection region configured to reflect at least in part the light coupled into the light modules in a signaling direction, wherein a particular reflection region occupies only a portion of a first light module of the at least two light modules in a peripheral direction of the first light module perpendicular to the main axis of the signaling apparatus, which portion is smaller than a total periphery of the light module, and wherein the reflection region of the first light module is arranged so as to be offset relative to the reflection region of a second light module of the at least two light modules by a predetermined angle perpendicular to the main axis, the reflection regions being at a same radial distance from the main axis.

2. The signaling apparatus according to claim 1, wherein the reflection regions of the light modules are each arranged so as to be aligned with at least one of the light sources in a direction parallel to the main axis in order to reflect emitted light from the corresponding light source.

3. The signaling apparatus according to claim 1, wherein all of the reflection regions of the light modules are identical.

4. The signaling apparatus according to claim 3, wherein all of the light modules have an identical design.

5. The signaling apparatus according to claim 1, further comprising a focusing unit configured to at least one of focus or guide the light generated by the respective light sources in parallel with the main axis.

6. The signaling apparatus according to claim 1, wherein the base unit comprises a printed circuit board and the light sources comprise light-emitting diodes arranged on the printed circuit board.

7. The signaling apparatus according to claim 1, wherein the light modules each comprise a solid illuminant in which the reflection regions are incorporated.

8. The signaling apparatus according to claim 1, wherein the reflection regions comprise optical mirror elements.

9. The signaling apparatus according to claim 1, wherein the signaling apparatus comprises a signal column.

10. At least one of a command device or an indicating device comprising the signaling apparatus according to claim 1.

* * * * *